United States Patent [19]

Gillström

[11] 4,041,859

[45] Aug. 16, 1977

[54] MARKING MACHINE

[76] Inventor: Uno K. Gillström, Alvkvarnsvagen 133, S-163 54 Spanga, Sweden

[21] Appl. No.: 634,102

[22] Filed: Nov. 21, 1975

[51] Int. Cl.[2] ..... B41J 1/60

[52] U.S. Cl. ..... 101/111; 101/105

[58] Field of Search ..... 101/111, 50, 105, 334, 101/333

[56] References Cited

U.S. PATENT DOCUMENTS

| | | | |
|---|---|---|---|
| 453,609 | 6/1891 | Bradley | 101/111 |
| 1,058,008 | 4/1913 | Standley | 101/111 |
| 3,119,328 | 1/1964 | Pittman et al. | 101/288 |
| 3,380,378 | 4/1968 | Edwards et al. | 101/111 |
| 3,744,411 | 7/1973 | Becker | 101/111 |
| 3,796,152 | 3/1974 | Finke et al. | 101/111 |

FOREIGN PATENT DOCUMENTS

| | | | |
|---|---|---|---|
| 1,259,908 | 8/1963 | Germany | 101/111 |

*Primary Examiner*—Edward M. Coven

*Attorney, Agent, or Firm*—Sughrue, Rothwell, Mion, Zinn and Macpeak

[57] ABSTRACT

The invention relates to a marking machine, comprising a carriage, reciprocatively movable relative to a label or the like on a pressure distributing pad, the carriage having a plurality of endless type bands consisting of type plates which are united to each other via flexible portions and running over at least one guiding pulley and a backing plate, which is substantially parallel to and opposite the pressure distributing pad, each type band comprising an elastic portion which is provided with a first area with consecutive type plates with individual symbols and a second area with the same type plates and symbols, said second area coacting with a window arranged in a cover plate over the type bands, so that a type plate disposed on the backing plate corresponds to a type plate lying at the window, the cover plate having longitudinal slots, one for each type band, there being an operating means projecting through the slot for displacing the band.

1 Claim, 3 Drawing Figures

MARKING MACHINE

BACKGROUND OF THE INVENTION

In many cases, e.g. in marking labels for goods, it is of the greatest importance that marking takes place with very large symbols, so that the label may be read even at a comparatively large distance. Machines available for the purpose are of very complicated type, and require very large label series with the same marking to be practically usable.

SUMMARY OF THE INVENTION

It is therefore an object of the invention to provide a simple and reliable marking machine which can be used for very large printing type without risk of band rupture and furthermore with self-centering type plates, whereby special locking or locating means for the type plates do not need to be arranged. This object is entirely realized by the invention disclosed in the patent claims.

BRIEF DESCRIPTION OF THE DRAWINGS

An embodiment of the invention will now be described in conjunction with the attached drawing, on which.

Figure 1:
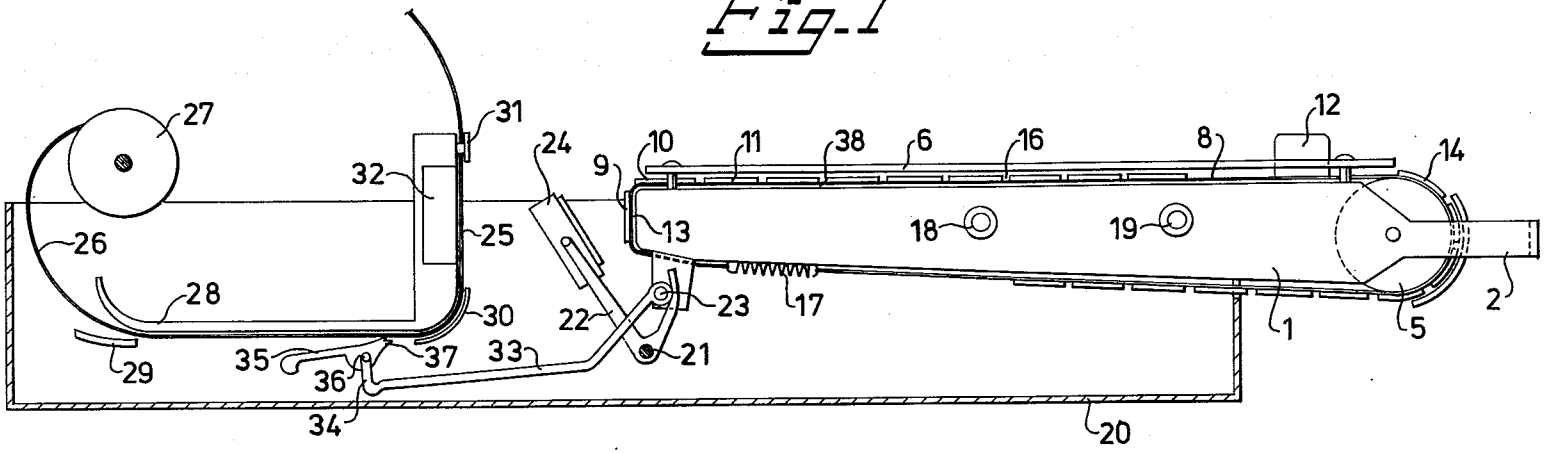
FIG. 1 shows a marking machine seen from one side and partly sectioned.
Figure 2:
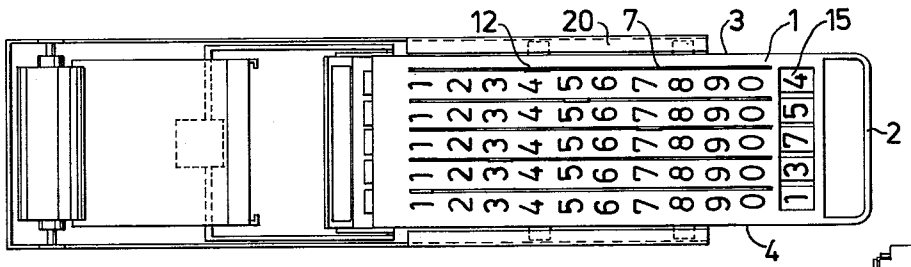
FIG. 2 shows the machine according to FIG. 1 seen from above and to a reduced scale.

The marking machine comprises, as is shown in FIGS. 1 and 2, a carriage 1, e.g. in the form of a frame with a handle 2. Between these side plates 3 and 4 of the frame, and adjacent to the handle 2, a freely rotating end wheel 5 is mounted for the bands. The upper side of the frame 1 is covered by a cover plate 6 with longitudinal slots e.g. slot 7. Under the cover plate 6 there are a plurality of type bands, e.g. type band 8, having type plates 9, 10, 11 etc. On each type band there is attached a displacing means 12, in the shape of a plate projecting up through the slot 7, allocated to the type band 8, and contoured for gripping with two fngers, Each type band has a double set of symbols which are so arranged that the type plate which for the moment is disposed on a substantially flat backing plate 13 corresponds to a type plate 14 which is at a window 15 in the cover plate 6. The type intended for printing is fed forward to the backing plate 13 by moving the displacing means 12, attached to the appropriate band, from the upper side of the cover plate 6. After setting the desired number, or word, or combination of letters, figures or other symbols has been completed the correctness of the setting can be quickly checked by looking at the symbol combination at the window 15.

The type band 8 is suitably completely manufactured from a flexible material e.g. fabric reinforced rubber, but the type plates are relatively rigid and are united by means intermediate easily flexible portions e.g. the portion 16.

As relatively large types are used, e.g. types with a height of 10 mm or more, the easily flexible but not notably stretchable portions 16, between the type plates in conventional type bands, will be exposed to severe tensional stresses when a type plate which is relatively rigid passes over the end wheel 5 and past the junction with the cover plate 6 and the backing plate 13. To eliminate these stresses there is arranged according to the invention, at least within a portion of the endless type band, yielding means e.g. one or more weak helical springs 17, rubber bands or the like, which at least partly take up the said tensional forces and allow the necessary extension of the band at the moment when the rigid type plate passes over the edge of the vertical flat backing plate 13 forming a flat base for the type plate.

In order to obtain the best guidance of the type bands, there is suitably arranged between the side plates 3 and 4 a supporting plate 38, forming an approximate right angle to the backing plate 13 and extending forward to the end wheel 5. When a rigid or at least substantially rigid type plate passes the junction between the supporting plate 38 and the backing plate 13, about half way along it will form an angle of approximately 45°with the supporting plate 38 and the backing plate 13, and the necessary extension of the respective type band for this is effectively allowed by the stretchable means 17, whereafter the type plate will, during the continued movement of the band, snap down onto the backing plate and automatically centre itself in the correct position with the flexible portion 16 disposed at the junction between the backing plate and the supporting plate. If the type band displacing means 12 should be accidentally moved too much or too little in relation to the marking on the cover plate, the type plate will automatically glide into the correct position on the backing plate when the displacing means has been released. This signifies a great advantage in comparison with conventional band markers, in which the tensioned. practically inelastic bands cause large stresses and the types are very often incorrectl, located on the backing plate.

On the side plates 3 and 4 , the carriage 1 has freely rotatable guiding rollers 18 and 19 gliding in grooves (not shown) in a frame 20.

In the frame 20 there is a cross shaft 21 on which a bell crank 22 is pivotably mounted. One arm of the bell crank 22 is at one end slidably engaged against a shaft 23 and the other arm carries an inking pad 24. When the carriage 1 is pushed to the right in FIG. 1, the inking pad 24 will be pivoted clockwise to engagement with the type plates at the backing plate 13, for inking-in the types, and when the carriage 1 is displaced to the left, the inking pad 24 will be pivoted anti-clockwise under its own weight to leave a free path of movement for the carriage, which can be moved against a label 25 applied to a label band 26, rolled up on a reel 27. There are guiding plates 28, 29, 30 and 31 for guiding the label band 26. In the marking position, the label which is to be printed is stationed against the surface of a pad 32, forming a springy base for obtaining a good impression.

For feeding the label band 26 forward, there is a forward feeding bar 33 which is pivotably mounted on the shaft 23 and at its free, upwardly bent end 34 it carries a feeding device 35, pivotably mounted on a horizontal pin 36, carried on the end 34. The feeding device 35 has a horizontally split feeding edge 37 forming two blades parallel with the horizontal side edges of the labels, the blade nearest the label band rubs against the band and when the carriage 1 is pulled backwards to the right in FIG. 1, it will catch the under edge of a label and pull the band forward the intended amount so that an unprinted label comes into the correct position against the pad 32. As the front edge of the feeder is split, the blade lying nearest to the label band is prevented from wedging itself between the label and the band to which the labels are applied, when self-adhesive lables are used. If a perforated band of lables is used, the split edge has a corresponding function and engages in a slot in the perforation.

Figure 3:
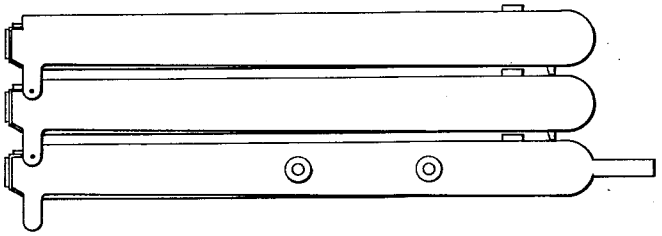
FIG. 3 shows an embodiment with the feature of simultaneously marking several rows.

The described device will print a row of symbols at a time on each lable. If a plurality of rows is to be printed simultaneously, e.g. three, then three carriages of the type described above are arranged as shown in a simplified fashion in FIG. 3, the carriages being liftable relative to each other for setting the symbols, and only the lowest carriage needs to be guided in the frame.

Although the type plates as illustrated are manufactured from rubber, for example, and that inking takes place with an inking pad, 24 it is also possible to made the type plates from metal joined together by flexible portions and to use an inking ribbon between the labels and the type plates to achieve the desired print.

The self-centering effect which is achieved according to the invention can be further reinforced by giving the end wheel 5 a polygonal configuration with a side of the polygon for each type plate, and furthermore the periphery of such a wheel can be substantially decreased in comparison with the circumference of a cylindrical wheel which must have a relatively large diameter to support the stiff type plates and prevent them from being exposed to excessive bending stresses. Each flat surface of the wheel has, just as the backing plate, a width corresponding to the width of the type plates, which are commonly all as wide. Even if only a single end wheel has been shown, it is obvious that a plurality of guiding wheels can be arranged along the path of movement of the respective band, and that the shown end wheel 5 can be divided up into separate end wheels, one for each band rotating on a common shaft.

I claim:

1. A marking machine comprising a frame, a pressure distributing pad adapted to support a label mounted on said frame, carriage means mounted for reciprocating movement relative to said pad, a backing plate secured to said carriage means in opposed parallel relation to said pad, pulley means rotatably mounted on said carriage means, a plurality of type bands disposed over said pulley means and said backing plate, supporting plate means secured to said carriage and extending the entire distance between said pulley means and said backing plate for supporting said type bands along the entire distance between said pulley means and said backing plate, cover plate means secured to said supporting plate means in spaced apart parallel relationship to said supporting plate means to define a guiding channel for said type bands, said cover plate means having a window for viewing said type bands and a plurality of longitudinal slots, one for each type band extending parallel to said type bands, displacing means attached to each band and projecting through a respective slot for displacing each band, each type band comprising an inelastic band, a first series of consecutive type plates with individual symbols secured to said band and a second series of type plates identical to said first series secured to said band and elastic means connecting the opposite ends of said band, said second series coacting with said window so that a type plate disposed on said backing plate corresponds to a type plate disposed beneath said window, said backing plate and said supporting plate means being disposed substantially at right angles to each other whereby said elastic means of said type bands allows said type plates to make the transition from said supporting plate means to said backing plate upon movement of the bands without damaging said bands.

* * * * *